US011568829B2

(12) United States Patent
Chen et al.

(10) Patent No.: US 11,568,829 B2
(45) Date of Patent: Jan. 31, 2023

(54) ELECTRONIC DEVICE AND DISPLAY IMAGE COMPENSATION METHOD THEREOF

(71) Applicant: ASUSTeK COMPUTER INC., Taipei (TW)

(72) Inventors: Yi-Ching Chen, Taipei (TW); Chin-An Tseng, Taipei (TW); Chia-Lei Yu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/502,085

(22) Filed: Oct. 15, 2021

(65) Prior Publication Data

US 2022/0130343 A1 Apr. 28, 2022

(30) Foreign Application Priority Data

Oct. 23, 2020 (CN) ..... 202011143087.X

(51) Int. Cl.
*G09G 3/36* (2006.01)
*G09G 5/06* (2006.01)

(52) U.S. Cl.
CPC ..... *G09G 3/3648* (2013.01); *G09G 5/06* (2013.01); *G09G 2320/041* (2013.01); *G09G 2320/045* (2013.01); *G09G 2320/066* (2013.01)

(58) Field of Classification Search
CPC .. G09G 3/3648; G09G 5/06; G09G 2320/041; G09G 2320/066; G09G 2320/0242
See application file for complete search history.

(56) References Cited

U.S. PATENT DOCUMENTS 9,135,889 B2 9/2015 Marcu et al.
10,937,365 B2 3/2021 Yang et al.
2005/0280766 A1* 12/2005 Johnson ..... G09G 3/3216 345/84
2019/0164475 A1* 5/2019 Zhao ..... G09G 3/006
(Continued)

FOREIGN PATENT DOCUMENTS

CN 102243848 A 11/2011
CN 106356024 A 1/2017
CN 108831380 A 11/2018
(Continued)

*Primary Examiner* — Roy P Rabindranath
(74) *Attorney, Agent, or Firm* — McClure, Qualey & Rodack, LLP

(57) ABSTRACT

An electronic device and a display image compensation method thereof are provided. The display image compensation method includes: receiving a first image signal and a second image signal sequentially at different time points, and displaying the first image signal by using a display unit; calculating current temperature information according to a display time length of the first image signal on the display unit and pixel data of the first image signal, and calculating a variation between the current temperature information and reference temperature information; and generating pixel compensation data corresponding to the current temperature information when the variation is greater than a preset value, compensating the second image signal according to the pixel compensation data, and outputting the compensated second image signal to the display unit.

7 Claims, 4 Drawing Sheets

(56) References Cited

U.S. PATENT DOCUMENTS

2021/0225287 A1* 7/2021 Meng ..... G09G 3/3291

FOREIGN PATENT DOCUMENTS

| | | | |
|---|---|---|---|
| CN | 109166526 | A | 1/2019 |
| CN | 109493805 | A | 3/2019 |
| CN | 110767148 | A | 2/2020 |
| JP | 2001134197 | A | 5/2001 |
| TW | 441157 | B | 6/2014 |

* cited by examiner

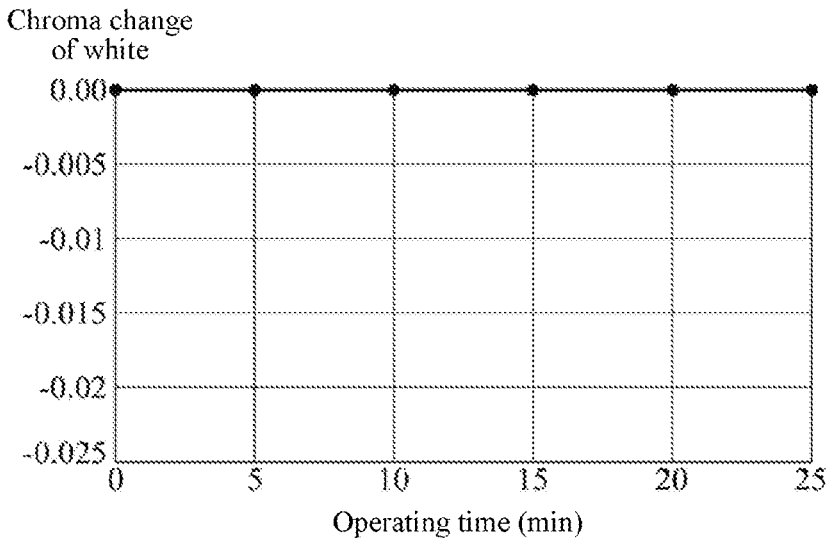
FIG. 4
| | | | |
|---|---|---|---|
| A1 | A2 | A3 | A4 |
| A5 | A6 | A7 | A8 |
| A9 | A10 | A11 | A12 |
| A13 | A14 | A15 | A16 |
FIG. 5A
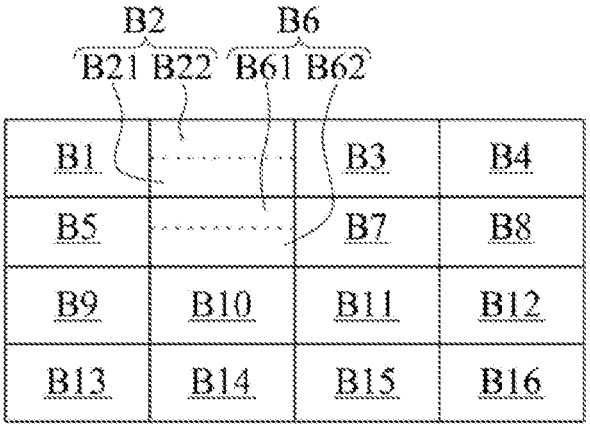
FIG. 5B

ELECTRONIC DEVICE AND DISPLAY IMAGE COMPENSATION METHOD THEREOF

CROSS-REFERENCE TO RELATED APPLICATION

This application claims the priority benefit of Chinese Application Serial No. 202011143087.X, filed on Oct. 23, 2020. The entirety of the above-mentioned patent application is hereby incorporated by reference herein and made a part of specification.

BACKGROUND OF THE INVENTION

Field of the Invention

This application relates to a display image compensation method, and in particular, to a display image compensation method for compensating an image based on a temperature of an electronic device.

Description of the Related Art

In a current high-dynamic-range (HDR) image that displayed by electronic devices, the brightness of a panel requires to be increased. The operating temperature of the electronic device rises as the display brightness increases and an operating time increases. Optical characteristics of a liquid crystal display (LCD) panel and a backlight module change due to the increase in temperature. As a result, color performance of the panel of the electronic device cannot keep stable due to the temperature change. In addition, local dimming algorithm applies in the LCD panel with an HDR capability as a displayed screen changes, however, it results in a temperature difference between different zones of the panel, and further results in a difference in color performance in different zones. Therefore, the overall color performance of the panel cannot keep stable.

BRIEF SUMMARY OF THE INVENTION

According to the first aspect of the disclosure, a display image compensation method is provided. The method includes: receiving a first image signal and a second image signal sequentially at different time points, and displaying the first image signal by a display unit; calculating current temperature information according to a display time length of the first image signal on the display unit and pixel data of the first image signal; calculating a variation between the current temperature information and the reference temperature information according to reference temperature information corresponding to the display unit before the display unit displays the first image signal; generating pixel compensation data corresponding to the current temperature information when the variation is greater than a preset value; and compensating the second image signal according to the pixel compensation data and outputting the compensated second image signal to the display unit.

According to the second aspect of the disclosure, a display image compensation method is provided. The display image compensation method includes: receiving a first image signal and a second image signal sequentially at different time points, and displaying the first image signal by a display unit, where the first image signal includes a plurality of image zones; calculating current temperature information corresponding to the image zones according to display time lengths of the image zones on the display unit and pixel data of the image zones; calculating variations between the current temperature information of the image zones and the reference temperature information corresponding to the image zones according to reference temperature information corresponding to the image zones before the display unit displays the first image signal; and generating, when a variation between current temperature information of a first zone in the image zones and reference temperature information corresponding to the first zone is greater than a preset value, first pixel compensation data corresponding to the current temperature information of the first zone; and compensating an image zone corresponding to the first zone in the second image signal according to the first pixel compensation data, and outputting the compensated second image signal to the display unit.

According to the third aspect of the disclosure, an electronic device is provided. The electronic device includes a receiving circuit, a display unit, a calculation circuit, a compensation data generation circuit, and a compensation circuit. The receiving circuit is configured to receive a first image signal and a second image signal sequentially. The display unit is configured to display the first image signal. The calculation circuit is coupled to the receiving circuit, and is configured to calculate current temperature information according to a display time length of the first image signal on the display unit and pixel data of the first image signal before the display unit displays the second image signal, and calculate a variation between the current temperature information and reference temperature information. The compensation data generation circuit is coupled to the calculation circuit, and is configured to generate pixel compensation data corresponding to the current temperature information when the variation is greater than a preset value. The compensation circuit is coupled to the receiving circuit and the display unit and is configured to compensate pixel data of the second image signal according to the pixel compensation data, and output the compensated second image signal to the display unit.

Based on the above, according to the electronic device of this application and an embodiment of the display image compensation method thereof, regardless of a display time length of the display unit, under the same display brightness setting, compensated image signals displayed on the display unit all have the same display chroma. The electronic device has good color performance. The electronic device calculates current temperature information according to an actual display time length of an image signal and pixel data without a temperature sensing circuit, thereby reducing costs while improving user experience. Furthermore, in a case of local dimming applied, the electronic device executes different compensation procedures of different compensation data based on different image zones of the image signal, so that the color performance of a panel is stable.

For other functions of this application and detailed content of embodiments, descriptions are provided below with reference to the accompanying drawings.

BRIEF DESCRIPTION OF THE DRAWINGS

To describe the technical solutions of the embodiments of this application or the existing technology more clearly, the following briefly introduces the accompanying drawings required for describing the embodiments or the existing technology. Apparently, the accompanying drawings in the following description show only some embodiments recorded in this application, and a person of ordinary skill in the art still derives other drawings from these accompanying drawings without creative efforts.

FIG. 4 is a schematic diagram of an embodiment in which chroma of white varies with an operating time;

FIG. 5A is a schematic diagram of an embodiment of a first image signal;

FIG. 5B is a schematic diagram of an embodiment of a second image signal;

DETAILED DESCRIPTION OF THE EMBODIMENTS

To make the objectives, features, and effects of this application more comprehensible, embodiments and accompanying drawings are provided to describe this application in detail in the following.

Figure 1:
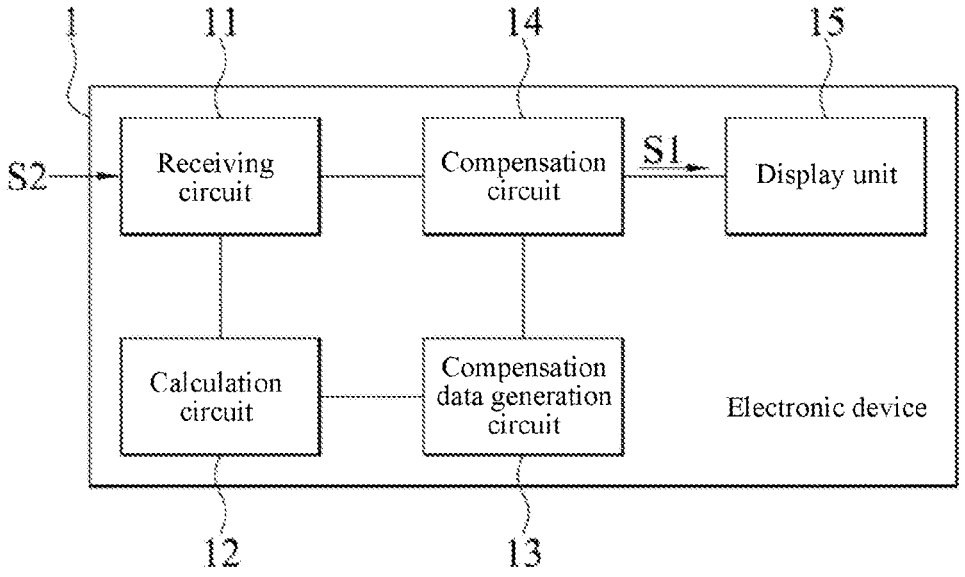
FIG. 1 is a schematic block diagram of an embodiment of an electronic device 1 according to this application.

FIG. 1 is a schematic block diagram of an embodiment of an electronic device 1 according to this application. Referring to FIG. 1, the electronic device 1 includes a receiving circuit 11, a calculation circuit 12, a compensation data generation circuit 13, a compensation circuit 14, and a display unit 15. The receiving circuit 11 is coupled to the calculation circuit 12 and the compensation circuit 14. The compensation circuit 14 is coupled to the compensation data generation circuit 13 and the display unit 15. The electronic device 1 sequentially receives, at different time points, an image signal S1 and an image signal S2 generated by an image signal source. The electronic device 1 receives the image signal S1 (hereinafter referred to as a first image signal S1) first. The display unit 15 displays the first image signal S1. Before the display unit 15 displays the second image signal S2, the electronic device 1 determines, according to a display time length of the first image signal S1 on the display unit 15 and pixel data of the first image signal S1, whether to compensate the second image signal S2. Therefore, the second image signal S2 subsequently displayed on the display unit 15 still maintains the same display chroma when the temperature of the electronic device 1 changes while the display unit 15 displays the first image signal S1 for a long time.

Figure 2:
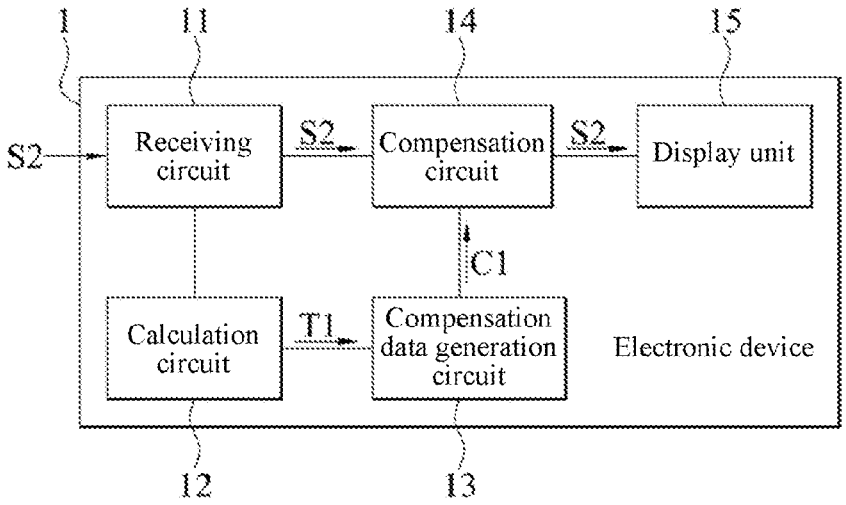
FIG. 2 is a schematic block diagram of an embodiment in which the electronic device 1 in FIG. 1 performs a display image compensation method for an image signal.
Figure 3:
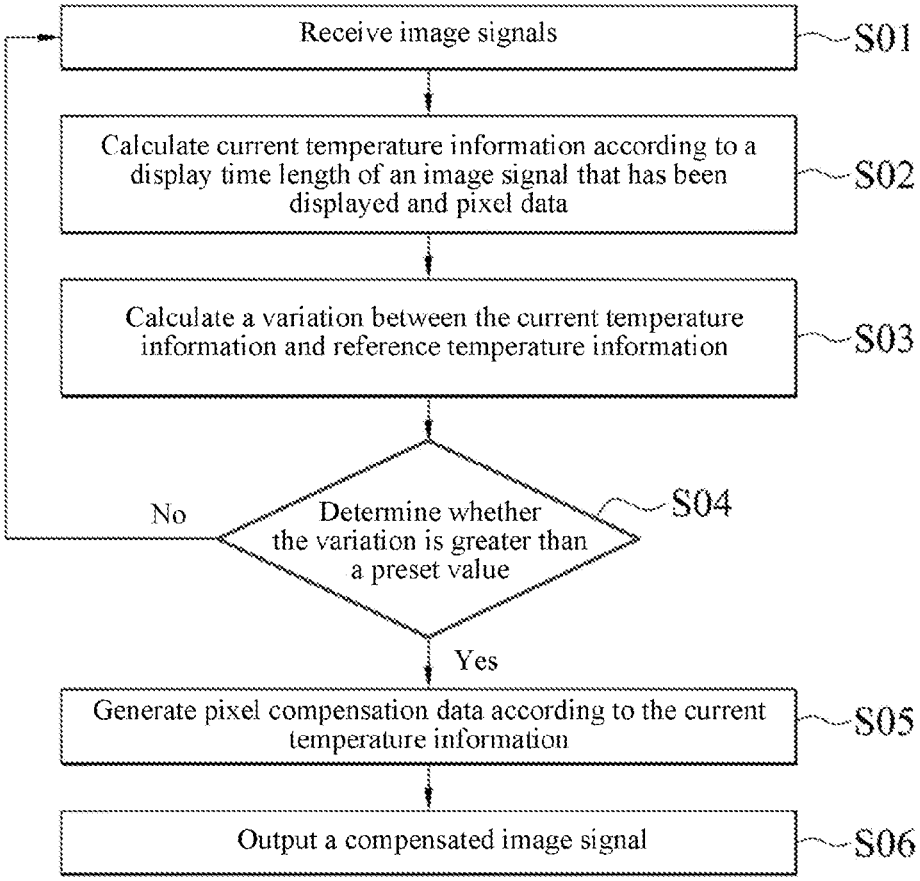
FIG. 3 is a flowchart of an embodiment of a display image compensation method according to this application.

Specifically, referring to both FIG. 2 and FIG. 3, after the receiving circuit 11 receives the second image signal S2 (step S01), the receiving circuit 11 transmits the second image signal S2 to the compensation circuit 14. Furthermore, the calculation circuit 12 calculates current temperature information T1 according to the display time length of the first image signal S1 displayed on the display unit 15 and the pixel data of the first image signal S1 (step S02). In an embodiment, the first image signal S1 has been displayed on the display unit 15 for 20 seconds (that is, the display time length is 20 seconds), and the pixel data of the first image signal S1 includes RGB information or YUV information. In step S02, the calculation circuit 12 calculates corresponding current temperature information T1 according to the display time length of the first image signal S1 and the RGB information of the first image signal S1. Next, the calculation circuit 12 compares the current temperature information T1 with reference temperature information received before the display unit 15 displays the first image signal S1. The calculation circuit 12 calculates a variation between the current temperature information T1 and the reference temperature information (step S03). The calculation circuit 12 determines whether the variation is greater than a preset value (step S04). When the variation is greater than the preset value (a determining result is "Yes"), indicating that the temperature of the electronic device 1 increases while the display unit 15 displays the first image signal S1 for a long time, and the compensation circuit 14 needs to compensate the second image signal S2. Therefore, the calculation circuit 12 transmits the current temperature information T1 to the compensation data generation circuit 13. The compensation data generation circuit 13 generates pixel compensation data C1 according to the current temperature information T1 (step S05). The compensation data generation circuit 13 then transmits the pixel compensation data C1 to the compensation circuit 14, so that the compensation circuit 14 compensates the second image signal S2 according to the pixel compensation data C1, and outputs the compensated second image signal S2 (step S06) to the display unit 15, and the display unit 15 displays the compensated second image signal S2. In an embodiment, the pixel compensation data C1 includes at least one of RGB information, YUV information, and setting information of a backlight module of the electronic device 1.

Based on the above, regardless of the display time length of the display unit 15, the compensation circuit 14 compensates the second image signal S2 according to the calculated pixel compensation data C1, so that the compensated second image signal S2 displayed on the display unit 15 maintains the same display chroma. Using a chromatic value change of white in the image signal displayed on the display unit 15 as an example, as shown in FIG. 4, the horizontal axis represents an operating time of the electronic device 1, and the vertical axis represents a chroma variation of white. It can be learned from FIG. 4 that regardless of the operating time of the electronic device 1, the chroma of white in the image signal displayed on the display unit 15 always has the same chromatic value. The electronic device 1 has good color performance. In addition, the electronic device 1 calculates the current temperature information according to an actual display time length of the first image signal S1 and the pixel data without a temperature sensing circuit, thereby reducing costs while improving user experience.

In an embodiment, in step S02, the calculation circuit 12 further calculates the current temperature information T1 according to a display brightness setting of the display unit 15. That is, the calculation circuit 12 calculates the current temperature information T1 according to the display brightness setting, the display time length of the first image signal S1, and the pixel data of the first image signal S1. Then, the compensation data generation circuit 13 correspondingly generates the pixel compensation data C1 including chroma data and brightness data, so that the compensation circuit 14 compensates chroma data and brightness data of the second image signal S2. In step S02, the display brightness setting is proportional to the current temperature information T1. When the display unit 15 displays the first image signal S1 with relatively high display brightness, the calculation circuit 12 calculates relatively high current temperature information T1. When the display unit 15 displays the first image signal S1 with relatively low display brightness, the calculation circuit 12 calculates relatively low current temperature information T1. In an embodiment, the display brightness setting is setting information of the backlight module of the electronic device 1. That is, the display brightness setting is a specified value of a function of adjusting screen brightness of the display unit 15.

In an embodiment, in step S04, when the variation is less than or equal to the preset value (the determining result is "No"), indicating that the display unit 15 does not increase the temperature of the electronic device 1 while displaying the first image signal S1 for a long time, thus the compensation circuit 14 does not need to compensate the second image signal S2. After the receiving circuit 11 receives the second image signal S2, the compensation circuit 14 transmits the second image signal S2 without compensating to the display unit 15, so that the display unit 15 displays the second image signal S2 without compensating.

In an embodiment, the image signals S1 and S2 individually include a plurality of image zones. When the display unit 15 displays the image signals S1 and S2, the plurality of image zones of the image signals S1 and S2 is displayed at different display positions on the display unit 15 at the same time. Therefore, at the same display time length, different pixel data of the plurality of image zones has different impact on temperatures at different display positions of the display unit 15. In step S02, the calculation circuit 12 calculates a plurality of pieces of current temperature information based on the plurality of image zones of the first image signal S1. Based on the above, accompany with embodiments showed in FIG. 5A and FIG. 5B, the first image signal S1 includes 16 image zones A1 to A16, and the second image signal S2 includes 16 image zones B1 to B16. The image zones B1 to B16 are in a one-to-one correspondence with the image zones A1 to A16. That is, the image zones A1 to A16 respectively correspond to the same display positions on the display unit 15 as the image zones B1 to B16. According to different pixel data of the image zones A1 to A16 and B1 to B16, the calculation circuit 12 determines impact of the image zones A1 to A16 with different pixel data on the temperatures at different display positions of the display unit 15 after the display unit 15 displays the first image signal S1 for a display time length. After the receiving circuit 11 receives the second image signal S2, the calculation circuit 12 further determines whether to compensate pixel data of the image zones B1 to B16 of the second image signal S2 according to the impact of the image zones A1 to A16 on the temperatures at the different display positions of the display unit 15.

In step S02, the calculation circuit 12 respectively calculates 16 pieces of current temperature information T1 to T16 corresponding to image zones A1 to A16 according to the display time length of the first image signal S1 on the display unit 15 and pixel data of the image zones A1 to A16. In step S03, the calculation circuit 12 further calculates, according to the current temperature information T1 to T16 of the image zones A1 to A16 and corresponding reference temperature information before the display unit 15 displays the first image signal S1, the variations between the current temperature information T1 to T16 and the corresponding reference temperature information. That is, the calculation circuit 12 calculates a variation between the current temperature information T1 and reference temperature information corresponding to the image zone A1, a variation between the current temperature information T2 and reference temperature information corresponding to the image zone A2, a variation between the current temperature information T3 and reference temperature information corresponding to the image zone A3, and so on. The calculation circuit 12 calculates 16 variations in total. Next, in step S04, the calculation circuit 12 determines whether each of the 16 variations corresponding to the image zones A1 to A16 is greater than a preset value. When the variation of any one of the image zones A1 to A16 is greater than the preset value (the determining result is "Yes"), the compensation data generation circuit 13 generates pixel compensation data according to the image zone of which the variation is greater than the preset value in the image zones A1 to A16. When all the 16 variations are greater than the preset value, the compensation data generation circuit 13 generates 16 pixel compensation data C1 to C16, so that the compensation circuit 14 compensates the corresponding image zones A1 to A16 according to the pixel compensation data C1 to C16.

In an embodiment, in step S04, when the calculation circuit 12 determines that a variation between the current temperature information T6 and the reference temperature information is greater than the preset value (the determining result is "Yes"), and the calculation circuit 12 determines, that variations between other current temperature information T1 to T5 and T7 to T16 and the corresponding reference temperature information are all less than the preset value, the calculation circuit 12 outputs the current temperature information T6 to the compensation data generation circuit 13. The compensation data generation circuit 13 generates the pixel compensation data C6 corresponding to the current temperature information T6. Then, the compensation circuit 14 compensates pixel data of the image zone A6 according to the pixel compensation data C6. In step S04, when the calculation circuit 12 determines that a variation between the current temperature information T9 and reference temperature information is greater than the preset value (the determining result is "Yes"), a variation between the current temperature information T13 and the reference temperature information is greater than the preset value (the determining result is "Yes"), and variations between other current temperature information T1 to T8, T10 to T12, and T14 to T16 and the corresponding reference temperature information are all less than the preset value, the calculation circuit 12 outputs the current temperature information T9 and T13 to the compensation data generation circuit 13. The compensation data generation circuit 13 generates the pixel compensation data C9 and C13 corresponding to the current temperature information T9 and T13. Then, the compensation circuit 14 compensates pixel data of the image zone B9 of the second image signal S2 according to the pixel compensation data C9, and compensates pixel data of the image zone B13 of the second image signal S2 according to the pixel compensation data C13.

It is to be noted that, in the foregoing embodiment, the reference temperature information corresponds to temperatures at different display positions of the display unit 15. That is, in step S03, the calculation circuit 12 calculates the variations of the current temperature information T1 to T16 based on reference temperature information of the 16 different display positions of the display unit 15, and determines whether the variations are greater than the preset value.

In an embodiment, the calculation circuit 12 is coupled to the display unit 15. The calculation circuit 12 includes a timer. The timer of the calculation circuit 12 counts the display time length of the first image signal S1 on the display unit 15, so that the current temperature information T1 to T16 is calculated according to the display time length of the first image signal S1 on the display unit 15.

Figure 7:
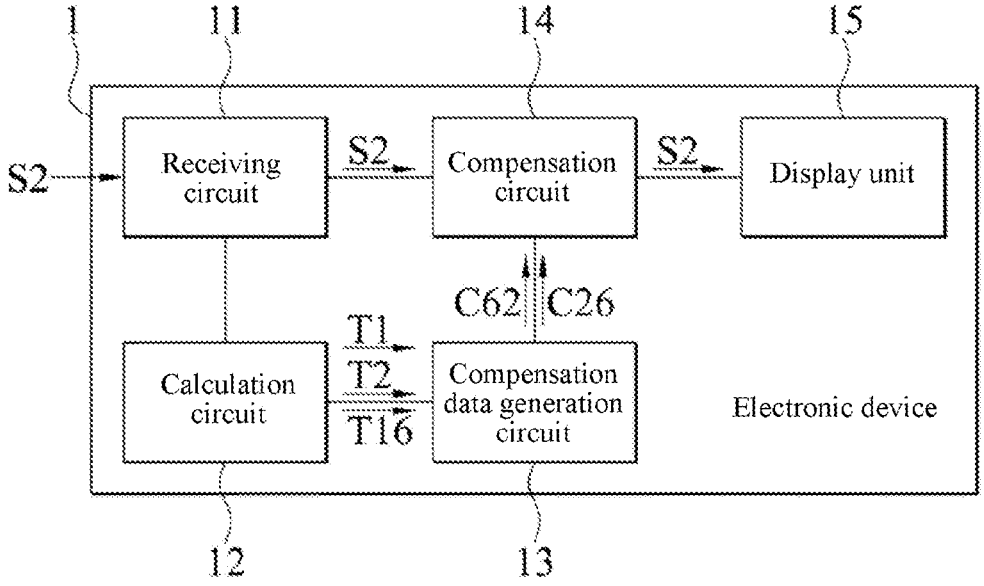
FIG. 7 is a schematic block diagram of another embodiment in which the electronic device 1 in FIG. 6 performs a display image compensation method for an image signal.

In an embodiment, based on two adjacent image zones in the image zones B1 to B16 of the second image signal S2, in step S05, the compensation data generation circuit 13 further calculates pixel compensation data of adjacent zones between the two adjacent image zones in the image zones B1 to B16 by an interpolation method. In an embodiment, as the embodiments shown in FIG. 5B, using the two adjacent image zones B2 and B6 in the image zones B1 to B16 as an example, the image zone B2 includes an adjacent zone B21 adjacent to the image zone B6 (hereinafter referred to as a first adjacent zone B21) and a border zone B22 far away from the image zone B6. The image zone B6 includes an adjacent zone B61 adjacent to the image zone B2 (hereinafter referred to as a second adjacent zone B61) and an adjacent zone B62 adjacent to the image zone B10. That is, the first adjacent zone B21 is adjacent to the second adjacent zone B61. If pixel compensation data C2 and C6 respectively corresponds to the image zones B2 and B6, in step S05, as shown in FIG. 7, the compensation data generation circuit 13 further generates first adjacent pixel compensation data C26 and second adjacent pixel compensation data C62 based on the pixel compensation data C2 and C6 by an interpolation method. In step S06, the compensation circuit 14 compensates pixel data of the border zone B22 by using the pixel compensation data C2, compensates pixel data of the first adjacent zone B21 by using the first adjacent pixel compensation data C26, and compensates pixel data of the second adjacent zone B61 by using the second adjacent pixel compensation data C62, so that a chroma change between the compensated first adjacent zone B21 and the compensated second adjacent zone B61 is relatively smooth, and the electronic device 1 has good color performance, thereby improving user experiences.

Figure 6:
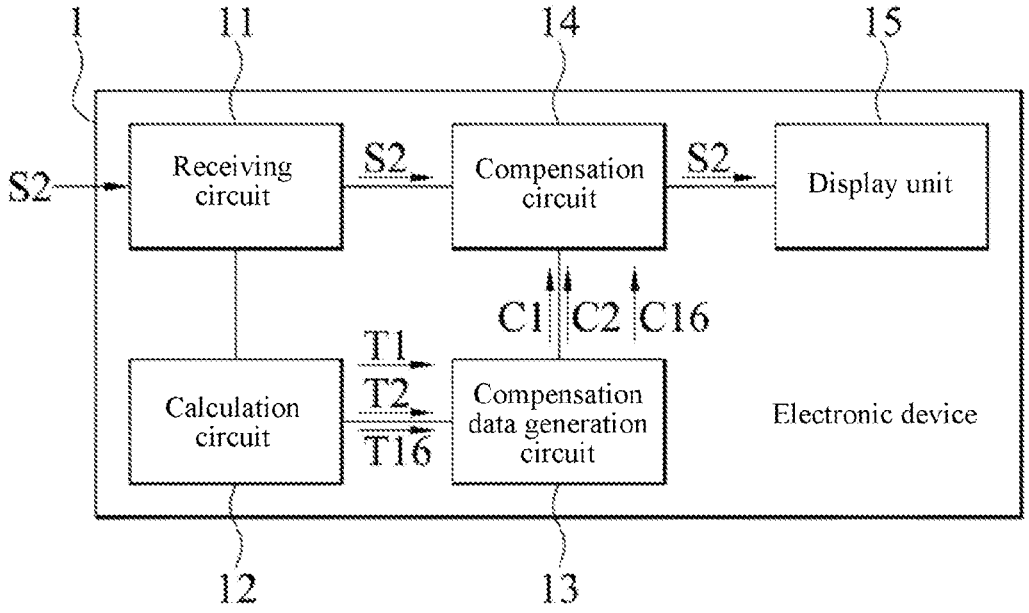
FIG. 6 is a schematic block diagram of another embodiment in which the electronic device 1 in FIG. 1 performs a display image compensation method for an image signal.

In an embodiment, in step S05, as shown in FIG. 6, the compensation data generation circuit 13 generates corresponding pixel compensation data C1 to C16 according to the current temperature information T1 to T16 by using a lookup-table method. In an embodiment, the compensation data generation circuit 13 is a memory unit. According to the different current temperature information T1 to T16, in the developing process of the electronic device 1, a designer of the electronic device 1 experiments to generate the pixel compensation data C1 to C16 corresponding to the different current temperature information T1 to T16, and stores the different pixel compensation data C1 to C16 in the compensation data generation circuit 13. During operation of the electronic device 1, the compensation data generation circuit 13 outputs the corresponding pixel compensation data C1 to C16 to the compensation circuit 14 according to the current temperature information T1 to T16 actually calculated by the calculation circuit 12 and a correspondence between the current temperature information T1 and the pixel compensation data C1.

In an embodiment, the receiving circuit 11, the calculation circuit 12, the compensation data generation circuit 13, and the compensation circuit 14 are implemented by one or more application-specific integrated circuits (ASICs) or microcontrollers (MCUs). The display unit 15 is a display panel. The electronic device 1 is a display, a mobile phone, or a notebook computer. That is, the receiving circuit 11, the calculation circuit 12, the compensation data generation circuit 13, and the compensation circuit 14 are configured in a display, a mobile phone, or a notebook computer. The display unit 15 is a display panel of the display, the mobile phone, or the notebook computer.

Based on the above, according to the electronic device of this application and an embodiment of the display image compensation method thereof, regardless of a display time length of the display unit, under the same display brightness setting, compensated image signals displayed on the display unit all have the same display chroma. The electronic device has good color performance. The electronic device calculates current temperature information according to an actual display time length of an image signal and pixel data without a temperature sensing circuit, thereby reducing costs while improving user experience. Furthermore, in a case of local dimming applied, the electronic device executes different compensation procedures of different compensation data based on different image zones of the image signal, so that the panel has stable color performance.

The foregoing embodiments and/or implementations are merely preferred embodiments and/or implementations used for describing the technologies in this application, and are not intended to limit implementation forms of the technologies in this application. A person skilled in the art can make alterations or modifications to obtain other equivalent embodiments without departing from the scope of the technical solutions disclosed in the content of this application. Such equivalent embodiments shall still be regarded as technologies or embodiments substantially the same as this application.

What is claimed is:

1. A display image compensation method, comprising:

receiving a first image signal and a second image signal sequentially at different time points, and displaying the first image signal by a display unit;

calculating current temperature information according to a display time length of the first image signal on the display unit and pixel data of the first image signal;

calculating a variation between the current temperature information and reference temperature information according to the reference temperature information corresponding to the display unit before the display unit displays the first image signal;

generating pixel compensation data corresponding to the current temperature information when the variation is greater than a preset value; and compensating the second image signal according to the pixel compensation data and outputting the compensated second image signal to the display unit;

wherein calculating the current temperature information comprises calculating the current temperature information according to the display time length of the first image signal on the display unit, the pixel data of the first image signal, and a display brightness setting of the display unit.

2. The display image compensation method according to claim 1, wherein the step of generating the pixel compensation data is generating the corresponding pixel compensation data according to the current temperature information by using a lookup-table method.

3. A display image compensation method, comprising:

receiving a first image signal and a second image signal sequentially at different time points, and displaying the first image signal by a display unit, wherein the first image signal comprises a plurality of image zones;

calculating current temperature information corresponding to the image zones according to display time lengths of the image zones on the display unit and pixel data of the image zones; calculating variations between the current temperature information of the image zones and reference temperature information corresponding to the image zones according to the reference temperature information corresponding to the image zones before the display unit displays the first image signal; and generating first pixel compensation data corresponding to the current temperature information of the first zone when a variation between current temperature information of a first zone in the image zones and reference temperature information corresponding to the first zone is greater than a preset value; and compensating an image zone corresponding to the first zone in the second image signal according to the first pixel compensation data, and outputting the compensated second image signal to the display unit;

wherein calculating the current temperature information corresponding to the image zones comprises calculating the current temperature information corresponding to the image zones according to the display time lengths of the image zones on the display unit, a display brightness setting of the display unit, and the pixel data of the image zones.

4. The display image compensation method according to claim 3, wherein the first zone is adjacent to a second zone in the image zones, the first zone comprises a first adjacent zone adjacent to the second zone, the second zone comprises a second adjacent zone adjacent to the first zone, and the display image compensation method further comprises:

calculating two pieces of adjacent pixel compensation data between the first pixel compensation data and the second pixel compensation data by using an interpolation method according to the first pixel compensation data and second pixel compensation data corresponding to the second zone; and compensating the first adjacent zone and the second adjacent zone according to the two pieces of adjacent pixel compensation data.

5. An electronic device, comprising:

a receiving circuit, configured to receive a first image signal and a second image signal sequentially;

a display unit, configured to display the first image signal;

a calculation circuit, coupled to the receiving circuit and configured to calculate current temperature information according to a display time length of the first image signal on the display unit and pixel data of the first image signal before the display unit displays the second image signal, and calculate a variation between the current temperature information and reference temperature information;

a compensation data generation circuit, coupled to the calculation circuit and configured to generate pixel compensation data corresponding to the current temperature information when the variation is greater than a preset value; and a compensation circuit, coupled to the receiving circuit and the display unit, and configured to compensate pixel data of the second image signal according to the pixel compensation data and output the compensated second image signal to the display unit;

wherein the calculation circuit calculates the current temperature information according to the display time length of the first image signal on the display unit, the pixel data of the first image signal, and a display brightness setting of the display unit.

6. The electronic device according to claim 5, wherein the first image signal comprises a plurality of image zones, the calculation circuit calculates current temperature information corresponding to the image zones according to the display time length and pixel data of the image zones, when a variation between current temperature information corresponding to a first zone in the image zones and reference temperature information corresponding to the first zone is greater than a preset value, the compensation data generation circuit generates the pixel compensation data as first pixel compensation data, and the compensation circuit compensates an image zone corresponding to the first zone in the second image signal according to the first pixel compensation data, and outputs the compensated second image signal to the display unit.

7. The electronic device according to claim 6, wherein the first zone is adjacent to a second zone in the image zones, the first zone comprises a first adjacent zone adjacent to the second zone, the second zone comprises a second adjacent zone adjacent to the first zone, and the compensation data generation circuit calculates, according to the first pixel compensation data and second pixel compensation data corresponding to the second zone, two pieces of adjacent pixel compensation data between the first pixel compensation data and the second pixel compensation data by an interpolation method, to cause the compensation circuit to compensate the first adjacent zone and the second adjacent zone according to the two pieces of adjacent pixel compensation data.

* * * * *